US005992119A

United States Patent [19]

Rokhlin

[11] Patent Number: 5,992,119

[45] Date of Patent: Nov. 30, 1999

[54] CONSTRUCTION BLOCK, AND A STRUCTURE PROVIDED WITH THE SAME

[76] Inventor: Zinoviy Rokhlin, 1626 Coney Island Ave., Brooklyn, N.Y. 11230

[21] Appl. No.: 08/953,366

[22] Filed: Oct. 17, 1997

[51] Int. Cl.[6] ..... E04C 1/10

[52] U.S. Cl. ..... 52/596; 52/606

[58] Field of Search ..... 52/596, 600, 603, 52/606, DIG. 9, 167.7, 309.7, DIG. 7

[56] References Cited

U.S. PATENT DOCUMENTS

| | | | |
|---|---|---|---|
| 4,427,818 | 1/1984 | Prusinski | 52/DIG. 9 X |
| 4,678,617 | 7/1987 | Sykes | 52/DIG. 9 X |
| 5,103,616 | 4/1992 | Nordberg | 52/585 |
| 5,167,336 | 12/1992 | Lajovic | 52/DIG. 9 X |
| 5,172,528 | 12/1992 | Clarke | 52/198 |
| 5,214,896 | 6/1993 | Hamilton | 52/563 |
| 5,214,897 | 6/1993 | Nordberg | 52/586 |
| 5,391,226 | 2/1995 | Frankowski | 52/DIG. 9 X |
| 5,472,750 | 12/1995 | Miller | 52/DIG. 9 X |
| 5,507,127 | 4/1996 | Gates | 52/605 |
| 5,718,413 | 2/1998 | Nagler | 52/DIG. 9 X |
| 5,746,037 | 5/1998 | Nordberg | 52/405.1 |
| 5,778,622 | 7/1998 | Baker | 52/405.3 |

*Primary Examiner*—Beth A. Aubrey
*Attorney, Agent, or Firm*—Ilya Zborovsky

[57] ABSTRACT

A structural block has a body which is yieldable in a transverse direction; and a plurality of reinforcing elements provided on the body and extending in a vertical direction, so that loads applied in a vertical direction are adequately taken by said reinforcing elements, while under the action of transverse forces the body can yield and therefore the whole structural element can yield.

12 Claims, 2 Drawing Sheets

CONSTRUCTION BLOCK, AND A STRUCTURE PROVIDED WITH THE SAME

BACKGROUND OF THE INVENTION

The present invention relates generally to the construction industry, and in particular to construction blocks as well as to structures provided with them.

It is known that the construction blocks are usually composed of various materials, such as for example stone, concrete, etc. In highly seismic areas it is however necessary to erect buildings which on the one hand are strong enough to support loads during their operation, and on the other hand can react during earthquakes so as not to be destroyed completely or at least partially. Several approaches are used for erecting earthquake-resistant buildings. It is believed that it is advisable to further improve the existing approaches.

SUMMARY OF THE INVENTION

Accordingly, it is an object of present invention to provide a construction block, and a structure provided with a construction block, which is a further improvement of existing earthquake-resisting structures.

In keeping with these objects and with others which will become apparent hereinafter, one feature of the present invention resides, briefly stated, in a construction block including a body which is substantially yieldable in a transverse direction without destruction and is provided with a plurality of reinforcing elements extending in a substantially vertical direction and not yieldable in the vertical direction, so that when forces are applied to the construction block it resists the forces applied in a vertical direction and yields under the action of the forces applied in a transverse direction.

When the construction block is designed in accordance with the present invention, it yields in a transverse direction without destruction, so that under the action of forces generated by earthquakes and the like a structure composed of such construction blocks can yield transversely without destruction, while in a vertical direction the blocks reliably support the normal loads during the operation of the structure.

Another object of the present invention is to provide a structure which includes a plurality of the blocks comprising the above specified elements.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
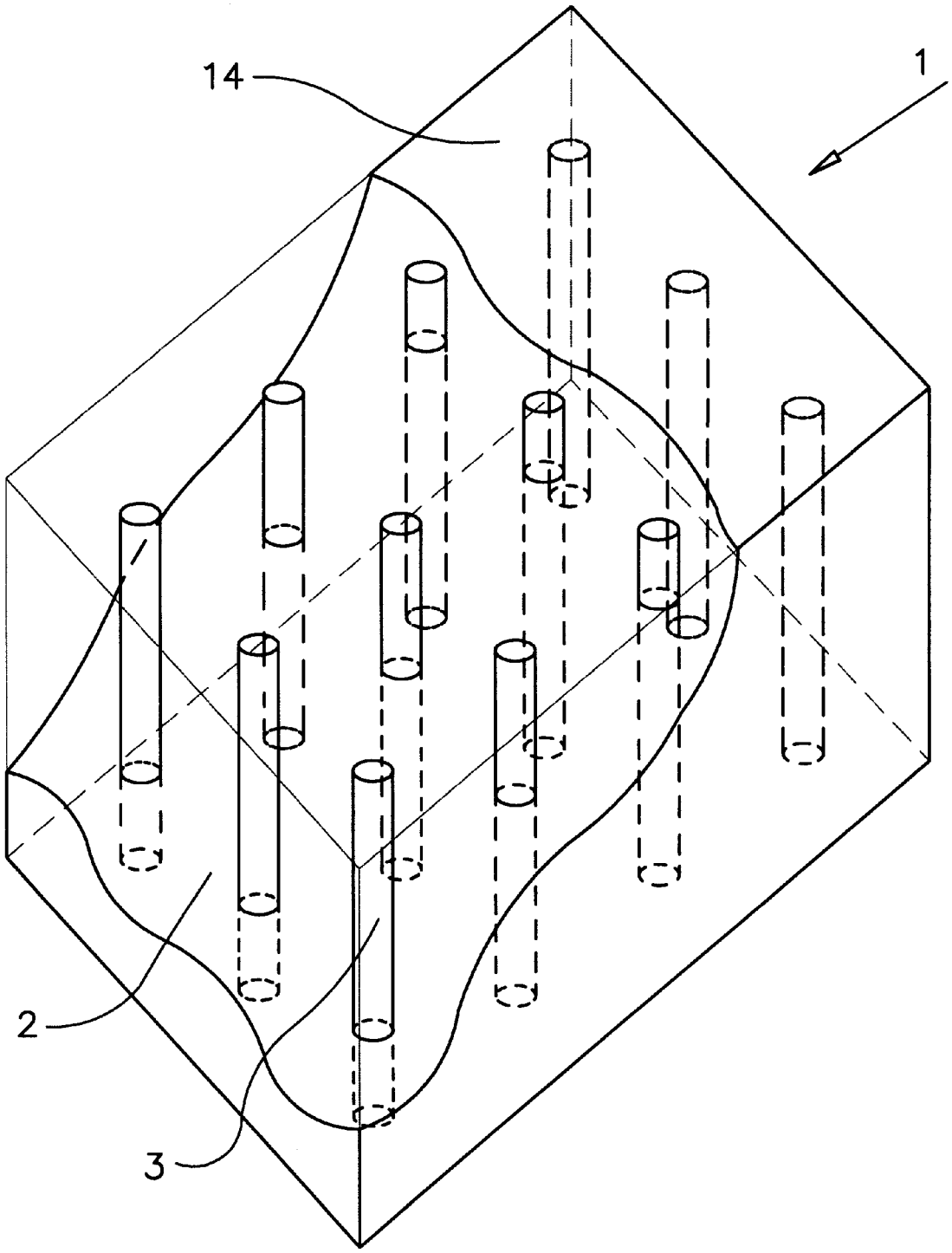
FIG. 1 is a view showing a perspective view of a new construction block in accordance with the present invention.

A construction block in accordance with the present invention is identified as a whole with reference numeral 1.

It has a body 2 which is composed of a material which can yield in a transverse direction or in a horizontal direction when the block is installed in a structure. The body 2 for this purpose can be composed for example of rubber, elastic synthetic plastic, etc., which can be provided with a filler such as particles of sand, comminuted stone, etc, to impart a certain strength to the body.

The construction block is provided additionally with a plurality of reinforcing elements which are identified with reference numeral 3. The reinforcing elements extend in a vertical direction of the structural block when it is installed in a structure. The reinforcing elements can be formed as rods composed of metal, synthetic plastic, etc. The reinforcing elements 3 are formed so that they withstand required vertical loads during the operation of a structure in which the structural blocks are used. On the other hand, they can somewhat yield in a transverse or horizontal direction under application of transverse forces.

The structural block can also be provided with an outer coating identified with reference numeral 14 formed as a thin skin, etc.

Figure 2:
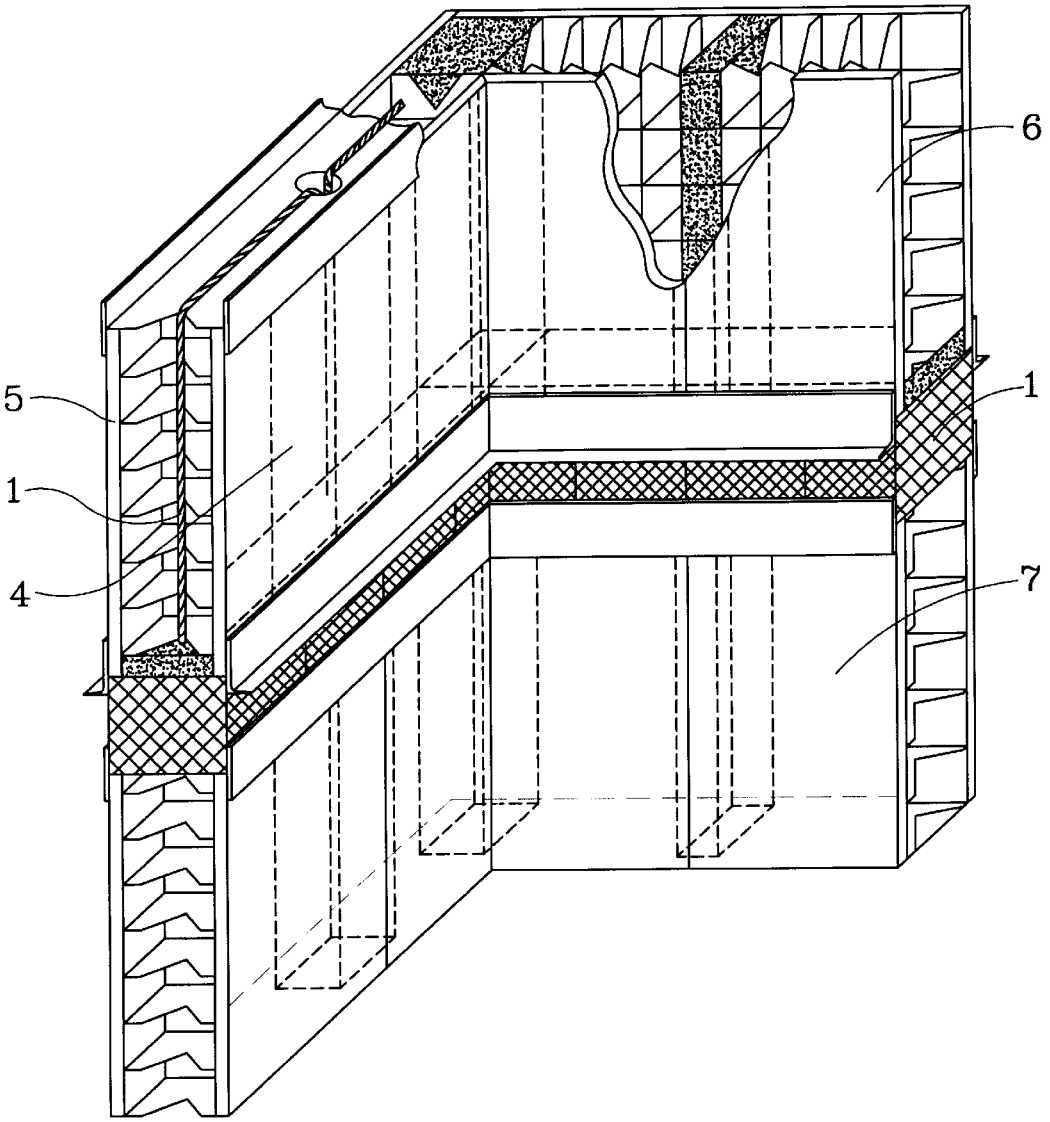
FIG. 2 is a view showing a part of a structure provided with the inventive construction blocks.

As can be seen from FIG. 2, the structural blocks in accordance with the present invention can be arranged in spaces between an inner portion 4 and an outer portion 5 of a wall of a structure. In this construction, the structural blocks 1 increase a resistence of the walls to destruction under the action of earthquakes.

As can be further seen from FIG. 2, the structural blocks 1 can be arranged between vertical panels 6 and 7 of the walls of a structure. In this case, they adequately support the vertical loads applied by the panels during the normal operation of the structure, and at the same time allow a certain horizontal movement of the panels relative to one another so as to better resist forces generated by earthquakes and the like.

It will be understood that each of the elements described above, or two or more together, may also find a useful application in other types of constructions differing from the types described above.

While the invention has been illustrated and described as embodied in a construction block, and a structure provided with the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A structural block for withstanding earthquakes, comprising a body which has a vertical direction and a transverse direction and is yieldable in said transverse direction; and a plurality of reinforcing elements provided in said body and extending in said vertical direction, so that loads applied in a vertical direction are supported by said reinforcing elements so as to support said loads during operation, while under the action of transverse forces generated by earthquakes the body can yield and therefore the reinforcing elements and the structural block can yield as a whole without destruction.

2. A structural block as defined in claim 1, wherein said body is composed of a material which is yieldable in said transverse direction.

3. A structural block as defined in claim 1, wherein said material is rubber.

4. A structural block as defined in claim 1, wherein said material is a synthetic plastic material.

5. A structural block as defined in claim 2, wherein said body is provided with a filler.

6. A structure for withstanding earthquakes, comprising at least two structural parts and at least one structural block located between said parts and including a body which has a vertical direction and a transverse direction and is yield in said transverse direction, and a plurality of reinforcing elements provided in said body and extending in said vertical direction, so that loads applied in a vertical direction are supported by said reinforcing elements so as to support said loads during operation, while under the action of transverse forces generated by earthquakes the reinforcing elements and the body as a whole can yield and therefore the structure can yield as a whole without destruction.

7. A structure as defined in claim 6, wherein said structural parts are an interior part and an exterior part of a wall, said structural block being located between said exterior part and said interior part.

8. A structure as defined in claim 6, wherein said structural parts are two vertical panels located one above the other, said structural block being located between said vertical panels.

9. A structure as defined in claim 6, wherein said body is composed of a material which is yieldable in said transverse direction.

10. A structure as defined in claim 6, wherein said material is rubber.

11. A structure as defined in claim 6, wherein said material is a synthetic plastic material.

12. A structure as defined in claim 6, wherein said body is provided with a filler.

* * * * *